US005678840A

United States Patent [19]

Simonian

[11] Patent Number: 5,678,840

[45] Date of Patent: Oct. 21, 1997

[54] VIBRATION DAMPING DEVICES FOR SKIS AND OTHER APPLICATIONS

[76] Inventor: Stepan S. Simonian, 5301 Sunnyview St., Torrance, Calif. 90505

[21] Appl. No.: 406,837

[22] Filed: Mar. 20, 1995

[51] Int. Cl.[6] ..... A63C 5/07

[52] U.S. Cl. ..... 280/602; 188/378; 188/268; 267/141

[58] Field of Search ..... 280/602; 248/562; 188/268, 378, 379; 267/136, 292, 141, 141.1, 153

[56] References Cited

U.S. PATENT DOCUMENTS

| | | | |
|---|---|---|---|
| 3,031,046 | 4/1962 | Hoadley | 188/268 |
| 3,078,969 | 2/1963 | Campbell | 188/268 |
| 3,078,971 | 2/1963 | Wallerstein | 188/268 |
| 3,110,262 | 11/1963 | West | 188/268 |
| 3,326,564 | 6/1967 | Heuvel | 280/602 |
| 3,412,725 | 11/1968 | Hoyt | 188/268 |
| 3,417,950 | 12/1968 | Johnson | 188/268 |
| 4,527,371 | 7/1985 | Hagbjer | 188/378 |
| 4,679,813 | 7/1987 | Girard | 280/602 |
| 4,865,345 | 9/1989 | Piegay | 280/602 |
| 5,143,394 | 9/1992 | Piana | 280/602 |

FOREIGN PATENT DOCUMENTS

| | | | |
|---|---|---|---|
| 3717629 | 12/1988 | Germany | 280/602 |

*Primary Examiner*—Anne Marie Boehler

*Attorney, Agent, or Firm*—Amster, Rothstein & Ebenstein

[57] ABSTRACT

Vibration damping devices for skis and other applications, the damping devices comprising a Cantilevered Impact/Friction Damper (CIFD) and an Improved Constrained Layer Damper (ICLD), the CIFD including a frame affixed to a portion of the vibrating body and having a cantilevered tubular member adapted for oscillation relative to the frame such that when subject to high amplitude vibration, a free end of the tubular member having a mass alternately strikes a pair of confronting stops, the tubular member having a plurality of particles disposed therein which dissipate low amplitude vibration through inter-particle friction; the ICLD comprising a spacer member having at least one layer of viscoelastic material and at least one constraining layer attached thereto, the spacer member having a plurality of slots spaced along the longitudinal extent thereof to reduce the bending stiffness of the spacer member without diminishing the damping effect.

6 Claims, 6 Drawing Sheets

VIBRATION DAMPING DEVICES FOR SKIS AND OTHER APPLICATIONS

BACKGROUND

1. Field of the Invention

This invention relates generally to damping vibration in a vibrating body, and more particularly, to vibration damping devices for skis, tennis rackets, golf clubs and other sporting equipment, or for any application requiring vibration damping.

2. Description of the Prior Art

It is well known that skis are subject to various modes of vibration as a natural consequence of the bending and twisting forces imparted to the ski by the skier and reactions generated by ski-snow contact. Unfortunately, when skis vibrate excessively, they become appreciably more difficult to control, particularly on hard or icy snow and at high speeds. The decreased stability and consequent poor edge control can cause control problems and diminished overall ski performance. One particular area of the ski where vibration is exacerbated by large excursions is proximal to the tip. Excessive tip vibration can cause the running surface to intermittently lift away from the snow and an unstable equilibrium condition arises where the only reaction force with the ground occurs below the boot. This condition affects the skier's balance since the restoring moment provided by contact of the running surface with the snow near the ski tip is eliminated. The temporal effect of this phenomena can be characterized as the settling time or dynamic stability of the ski. A damped ski has a smaller settling time than that of an undamped ski, and is said to have better dynamic stability. The longer the settling time, the longer the period of instability and the greater the risk of falling. In addition, because steady state vibration amplitude at resonance is inversely proportional to the amount of damping, the greater the damping factor, the lower the steady state vibration. Of course, too much damping has detrimental effects on ski performance. The amount of damping must be selected so as not to render the ski "dead" i.e., unresponsive. Over-damped skis are more stable but less maneuverable and more difficult to turn.

The prior art contains two fundamental approaches to ski damping. The first utilizes what is known as a tuned mass damper (TMD). A TMD damps vibration in a vibrating body by moving an oscillating mass in generally the same directions as the vibratory excursions but with opposite phase. The second approach, referred to as constrained layer damping, attenuates vibration by the conversion of vibration energy into heat through interlaminar shear generated between a layer(s) of relatively stiff material and a contiguous layer(s) of relatively elastic material such as a viscoelastic sheet.

An example of a TMD is disclosed in U.S. Pat. No. 4,018,454, which teaches several embodiments in which a vibrating mass is employed to attenuate ski vibration. In a first embodiment, the TMD consists of a mass supported by springs to move within a housing at substantially right angles to the ski. In another embodiment, the mass consists of a rocker arm biased by a tension spring, where the arm extends rearwardly from the ski tip and parallel to the ski. In yet another embodiment, a portion of the ski tip constitutes the mass and is hinged relative to the rest of the ski. When the ski vibrates, the mass moves and exerts forces on the ski which oppose excursions of the latter. It is claimed that the resonant frequency of the TMD is selected to lie within the range of from about 1 to 40 Hz.

Another TMD is shown in U.S. Pat. No. 4,563,020, which is specifically adapted for damping intermediate frequency vibrations identified in the patent as residing in the range of from about 100–500 Hz. The damper consists of a disk having a thickness diameter ratio between ⅓ and 1/30 and a specific gravity greater than 10, sandwiched between two foam inserts within a housing. The entire assembly is disposed at the tip of the ski.

Another type of damper is disclosed in U.S. Pat. No. 4,674,763, in which a plurality of small pellets are packed into a flexible bag, where the bag and pellets are contained in a housing attached to the tip of the ski. The pellets are arranged in layers such that during ski vibration they are displaced relative to and impact each other to dissipate kinetic energy by diverting vertical energy into horizontal energy. The energy is consequently dispersed in all directions, thereby neutralizing itself.

With respect to layer damping, U.S. Pat. Nos. 4,995,630 and 4,865,345 teach vibration dampers in which ski damping is effectuated through a laminated assembly comprised of relatively stiff constraining layers and viscoelastic sheets displaced from the top surface of the ski to enhance the damping effect.

Other implementations of layer damping incorporate viscoelastic or other elastic materials in the lay-up of the ski itself. Examples of these arrangements may be found in U.S. Pat. Nos. 4,405,149 and 4,438,946.

SUMMARY OF THE INVENTION

In view of the foregoing, it is a primary object of the invention to provide damping devices for skis which enhance ski performance by attenuating ski vibration.

It is another object of the invention to provide a cantilevered impact/friction damper for damping high and low amplitude vibrations, particularly at lower frequencies where high amplitude vibration is most prevalent.

It is another object of the invention to provide a cantilevered impact/friction damper which dissipates low amplitude vibration by inter-particle friction between a plurality of particles tightly packed within a cantilevered tube and where the cantilevered tube has a mass disposed at one end thereof, which mass and tube strike confronting stops to dissipate high amplitude vibration.

It is another object of the invention to provide a cantilevered impact/friction damper wherein the damping of higher amplitude vibration is selectable by the skier by adjusting the relative distances between the confronting stops and the cantilevered tube.

It is another object of the present invention to provide a cantilevered impact/friction damper for use with a multitude of ski types wherein the damping is selectable to provide optimum damping for a given ski's vibrational characteristics.

It is another object of the invention to provide a cantilevered impact/friction damper wherein the cantilevered tube impacts the confronting stops during high amplitude vibration in certain directions, yet does not impact anything during lateral excitation.

It is another object of the invention to provide an improved constrained layer damper which exhibits superior damping properties without imparting appreciable bending stiffness to the vibrating body.

It is still another object of the invention to provide a constrained layer damper which provides enhanced shear strength without imparting appreciable bending stiffness to the vibrating body.

It is yet another object of the present invention to provide a constrained layer damper which can be used to attentuate vibration in a multitude of applications, including but not limited to tennis rackets, golf clubs, or other sporting equipment or for any other application requiring vibration damping.

It is a further object of the invention to provide a damping system for skis, incorporating both a cantilevered impact/friction damper and an improved constrained layer damper for superior overall damping performance.

In accordance with the above objects and additional objects which will become apparent hereinafter, the present invention provides a Cantilevered Impact/Friction Damper (hereinafter referenced to as CIFD) comprised of a frame for attachment to a ski or other vibrating body, and a cantilevered tubular member attached to the frame, the tubular member having a mass disposed at one end thereof and a plurality of particles stuffed into an interior chamber of the tubular member. The frame is fabricated from a rigid plastic or composite material, or from metal, and is rigidly affixed to the vibrating body. The frame has an attachment area for the cantilevered tubular member and a pair of stops disposed in confronting relation about the tubular member against which the tip of the tubular member and mass impact as a consequence of high amplitude vibration.

The tubular member is constructed from a flexible material such as an elastic plastic or rubber. The particles are stuffed into the tubular member, preferably in a sufficient amount or density to diametrically expand the tubular member so as to impose a preloaded force on the particles. The greater the number of particles, the higher the stiffness of the tubular member. The CIFD operates to damp both low amplitude and high amplitude vibration across a wide frequency band. During low amplitude vibration, the vibration kinetic energy transferred from the vibrating body through the frame is primary dissipated as heat through inter-particle dry friction between particles in the tubular member. At higher amplitudes, in addition to the damping effect of particle friction described above, the end of the tubular member containing the mass will alternatively strike the confronting stops to dissipate vibration by absorbing energy, i.e., momentum transfer.

In a ski application, the CIFD is disposed where vibratory excursions are of the greatest amplitude, typically proximal to the ski tip and/or ski tail. Experimentation has demonstrated that the desired damping effect may be achieved in a damper using a tube length of from about two (2) to four (4) inches and a tubular assembly weight of from about 0.5 to 1.5 ounces. The tube/stop impact during high amplitude vibration may be quantified as the coefficient of restitution. For a rigid tube/stop combination the coefficient of restitution approaches 1, whereas for a very resilient tube/stop combination the coefficient of restitution approaches 0. Preferably, the coefficient of restitution is selected to fall within the range of from about 0.2 to 0.7 for most applications.

The present invention also provides an Improved Constrained Layer Damper (hereinafter referred to as a ICLD) comprised of a support structure or spacer having an elongated longitudinal extent, at least one viscoelastic layer attached to the spacer and a constraining layer attached to the viscoelastic layer. The spacer displaces the viscoelastic layer from the vibrating body and provides enhanced damping characteristics. To avoid imparting any appreciable bending stiffness to the vibrating body, however, the spacer contains a plurality of slots or apertures spaced along the longitudinal extent of the spacer. This arrangement has an additional benefit in that it increases the shear strength of the assembly.

The ICLD is constructed by bonding or otherwise securing a viscoelastic material to the spacer and then bonding a constraining layer to the viscoelastic material. The viscoelastic material should have a high loss factor of from about 0.3 to greater than 1 in the frequency band and temperature range of interest, and a sheet thickness typically in the range of from about 0.003 to 0.030 inches. The slots in the spacer are typically spaced apart in a periodic fashion with contiguous slots being separated by about 0.25 to 1.25 inches where each slot is about 0.008 to 0.1 inches in width. The spacer is typically configured so as to generate a space between the vibrating body and the viscoelastic layer in the range of from about 0.02 to 0.5 inches. Illustrative spacers disclosed herein have cross-sections in the form of a hat section, rectangular tube, nested rectangular tube, I-beam, C-beam and the like. The CIFD and ICLD may be utilized separately or in combination depending on the amount of damping necessary for the particular application. The advantages of this damping system will be more easily understood with reference to the accompanying drawings and detailed description which follows.

Figure 1A:
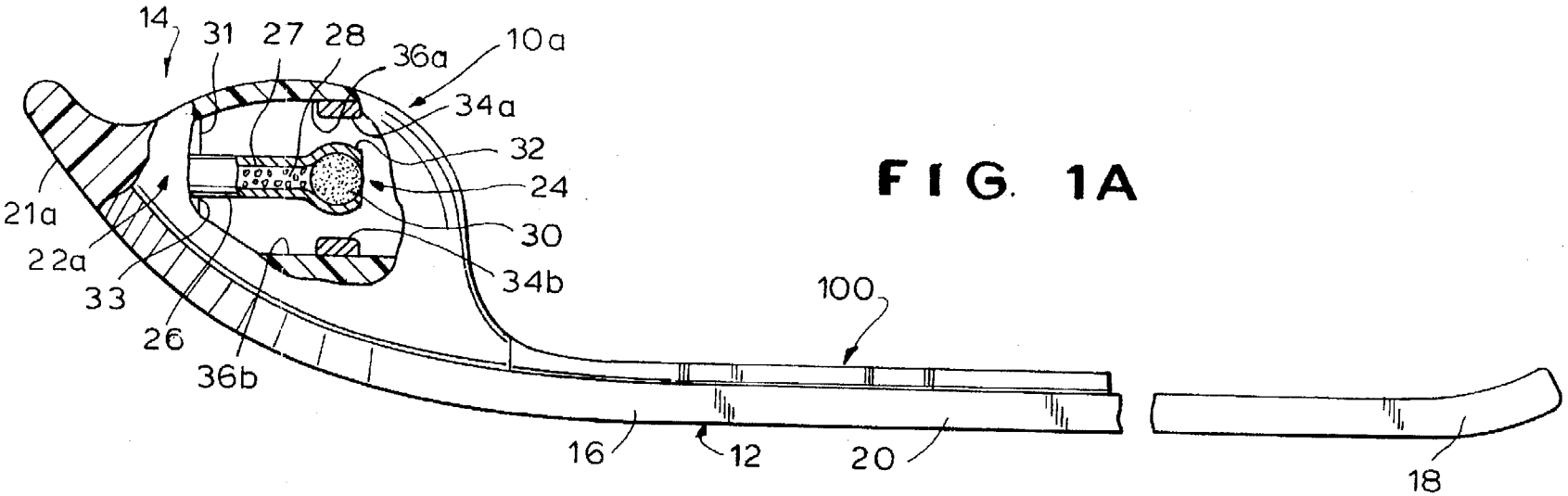
FIG. 1A is a side elevational view of a ski with a CIFD and ICLD in one embodiment in accordance with the present invention.
Figure 2A:
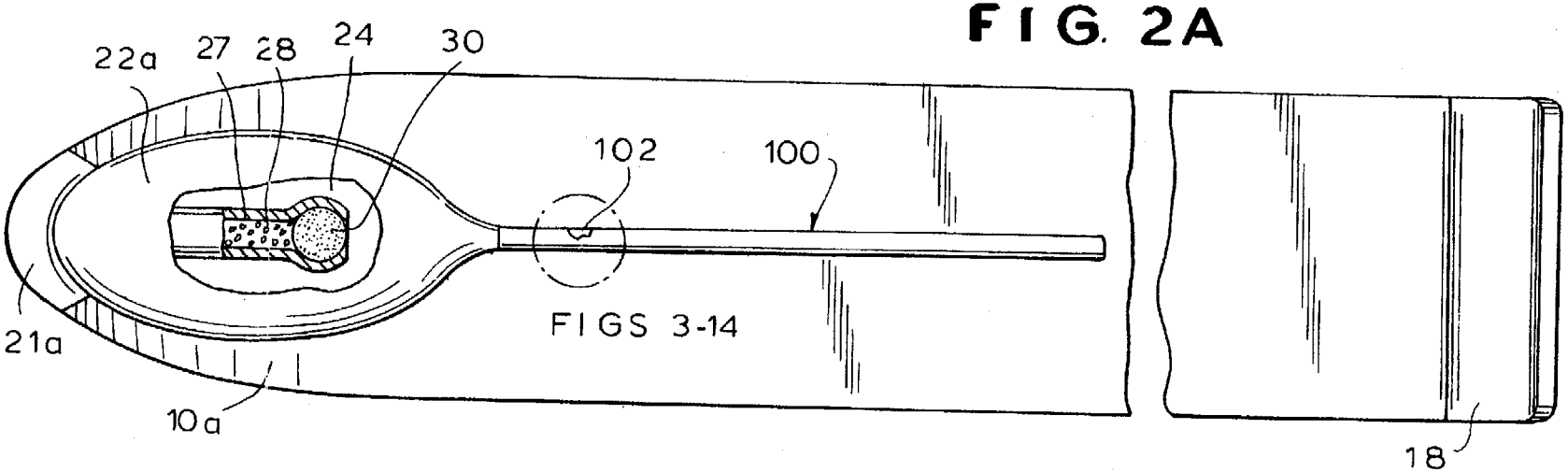
FIG. 2A is a top plan view thereof.
Figure 1B:
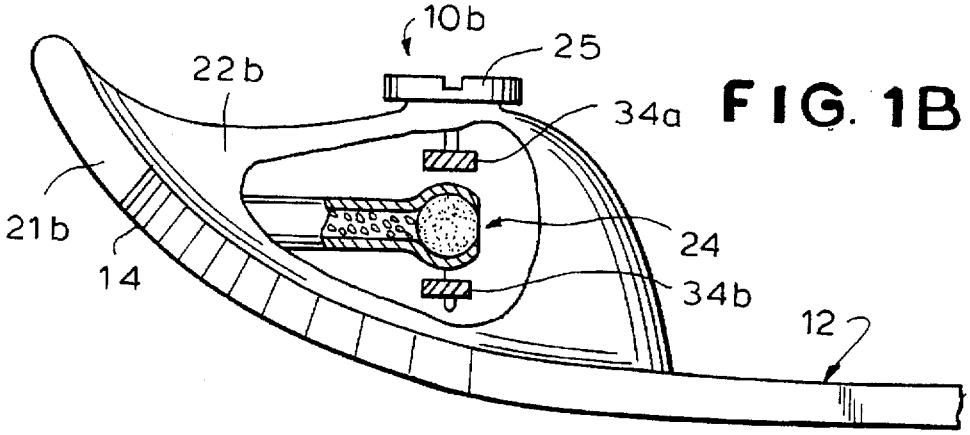
Figure 2B:
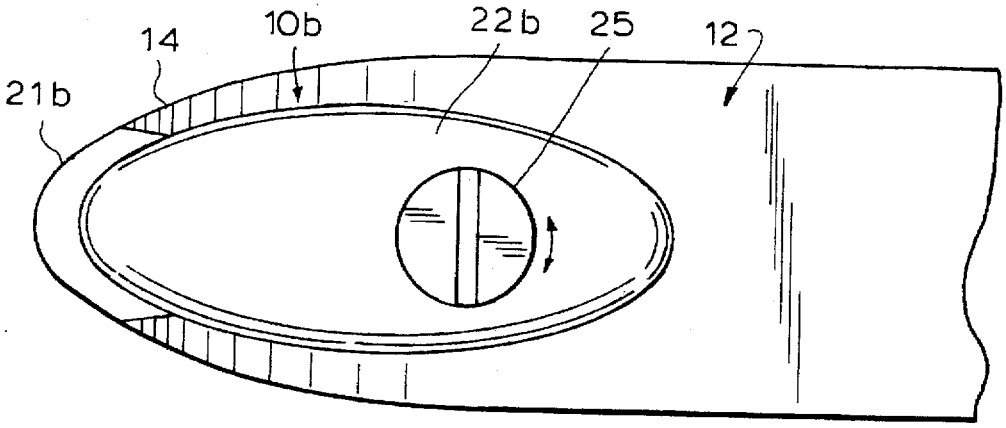
Figure 1D:
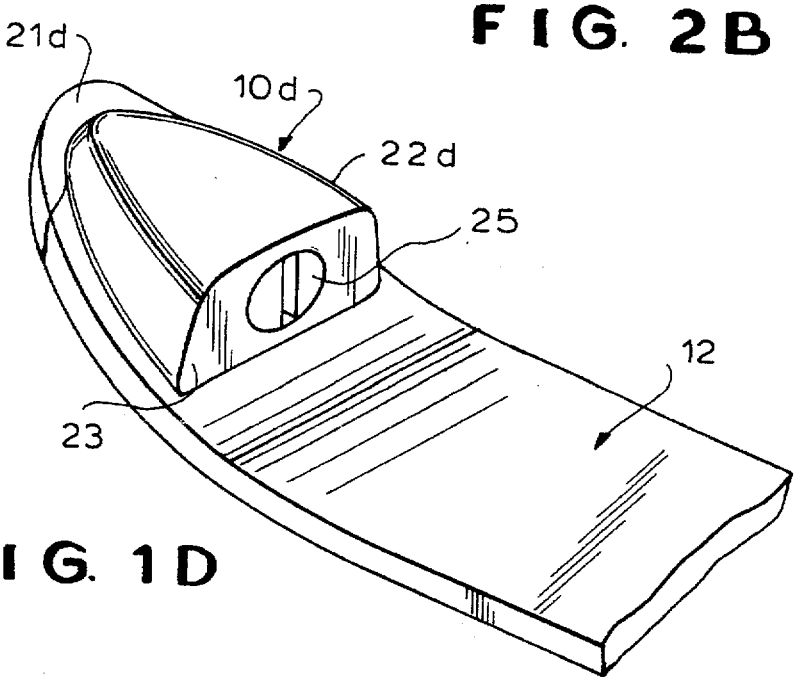
Figure 1C:
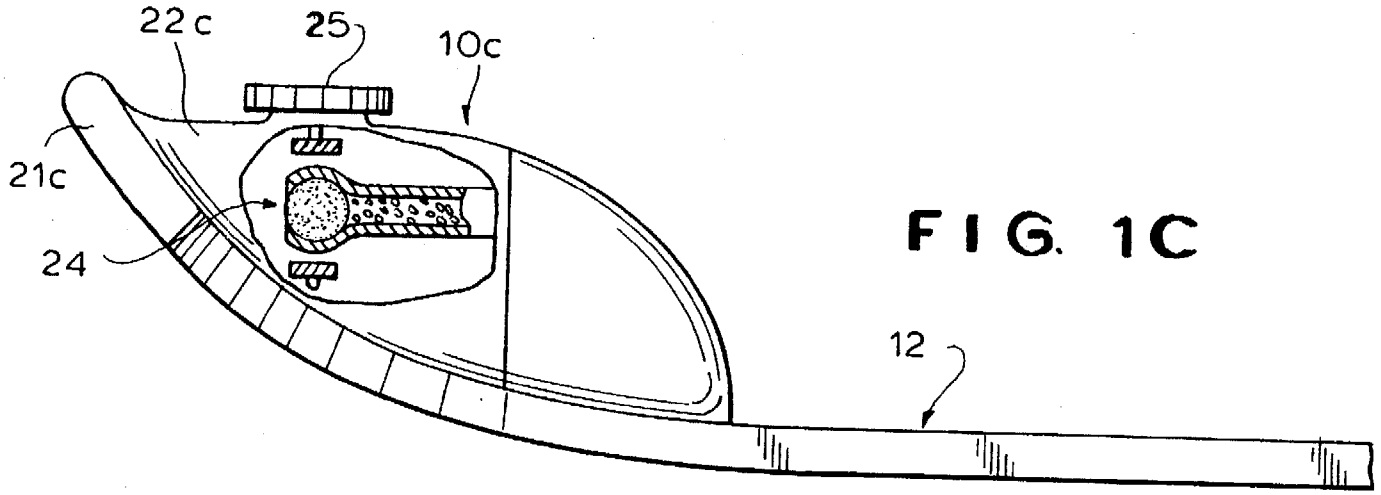
Figure 2C:
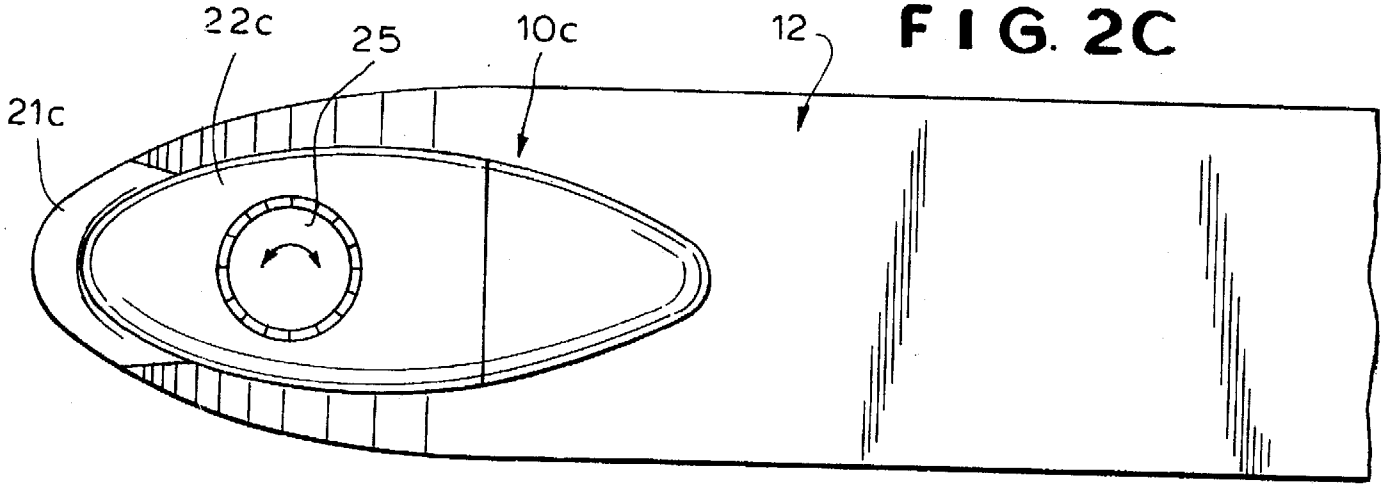
Figure 3:
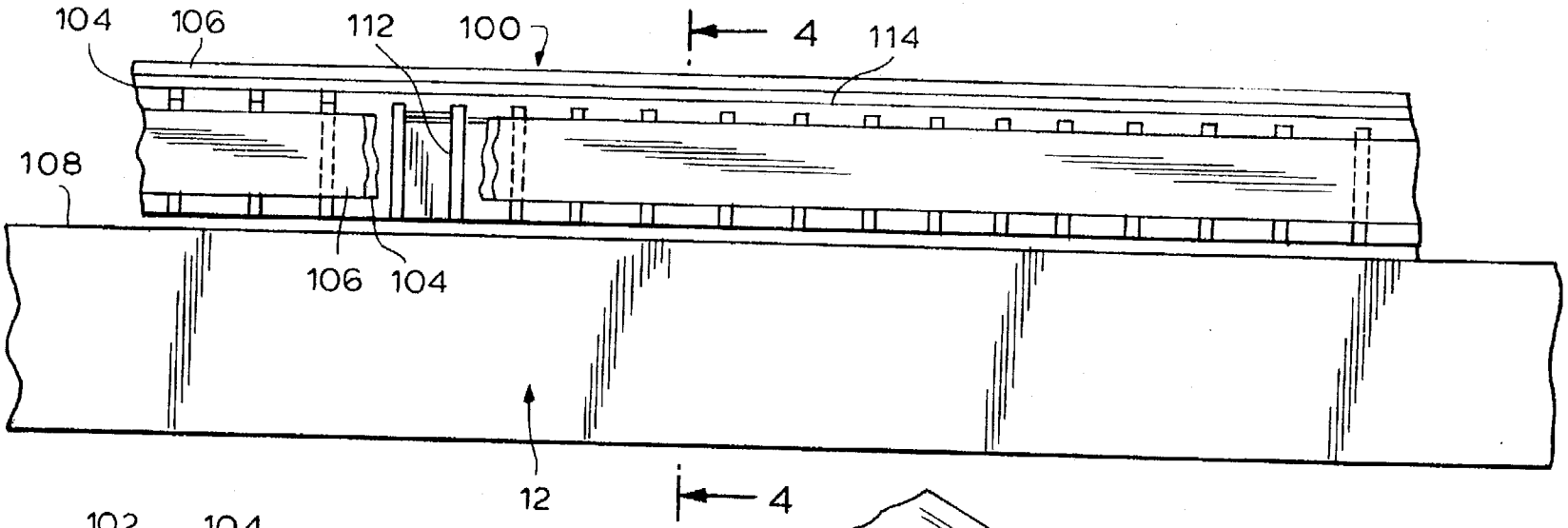
Figure 5:
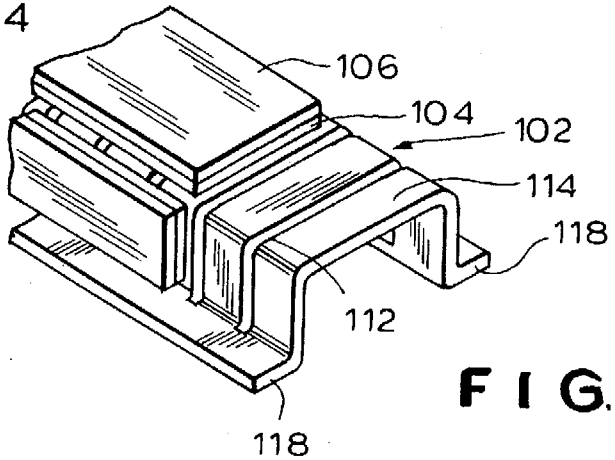
Figure 4:
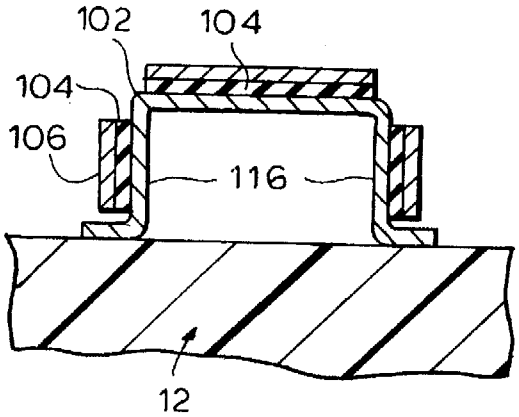
Figure 6:
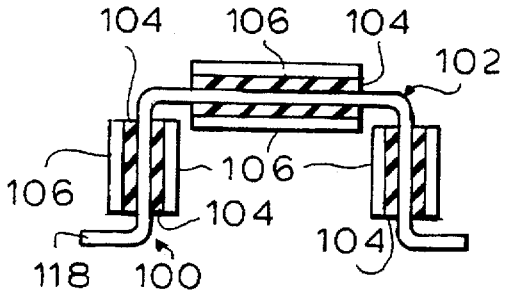
Figure 7:
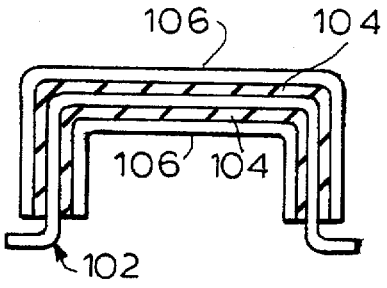
Figure 8:
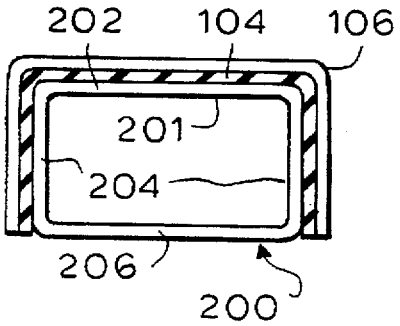
Figure 9:
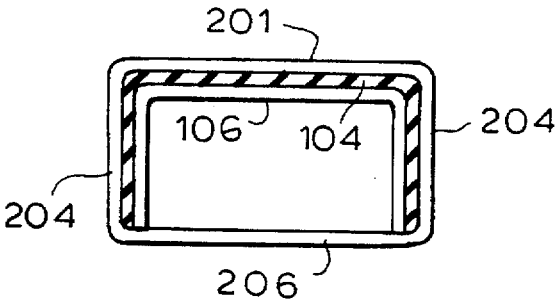
Figure 10:
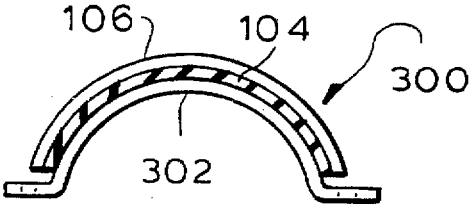
Figure 11:
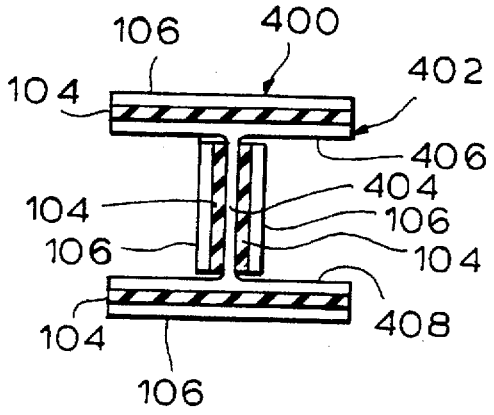
Figure 12:
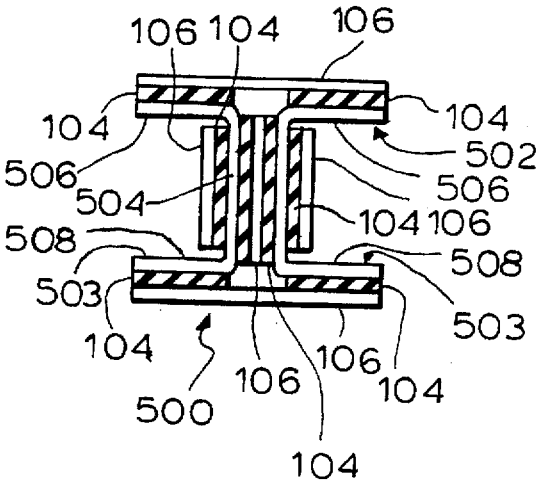
Figure 13:
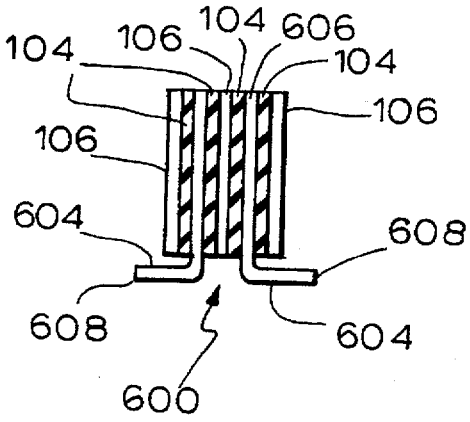

FIB. 1B is a side elevational view of a ski with a CIFD in a second embodiment wherein the damping of high amplitude vibration is adjustable;

FIG. 2B is a top plan view thereof;

FIG. 1C is a side elevational view of a ski with a CIFD in a third embodiment wherein the damping of high amplitude vibration is adjustable;

FIG. 2C is a top plan view thereof;

FIG. 1D is an isometric view of a CIFD in a fourth embodiment in which the damping of high amplitude vibration is adjustable;

FIG. 3 is partial side elevational view of the ICLD installed on the top surface of the ski;

FIG. 4 is a sectional view along lines 4—4 in FIG. 3;

FIG. 5 is a partial isometric view of the ICLD shown in FIGS. 3 and 4;

FIG. 6 is a modification of the embodiment shown in FIGS. 3 and 4;

FIG. 7 is yet another modification of the embodiment shown in FIGS. 3 and 4;

FIG. 8 is a second spacer embodiment;

FIG. 9 is a modification of the embodiment shown in FIG. 8;

FIG. 10 is a third spacer embodiment;

FIG. 11 is a fourth spacer embodiment;

FIG. 12 is a fifth spacer embodiment;

FIG. 13 is a sixth spacer embodiment; and

Figure 14:
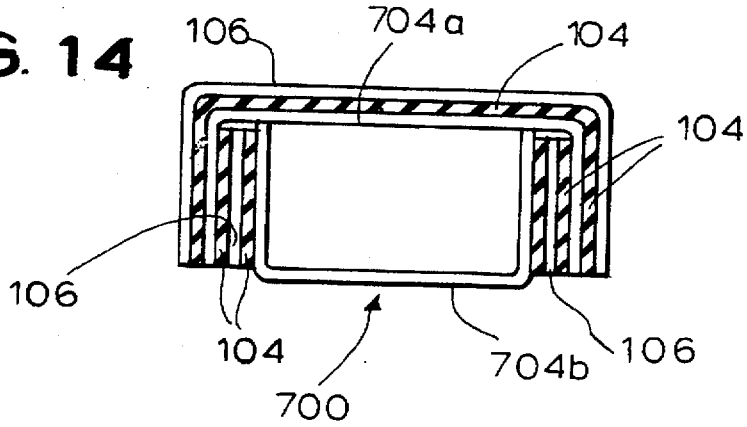

FIG. 14 is a seventh spacer embodiment.

DETAILED DESCRIPTION OF THE PREFERRED EMBODIMENTS

With reference to the several views of the drawings, there are depicted vibration damping devices for vibrating bodies shown in an exemplary embodiment with respect to skis.

Referring now to FIGS. 1A and 2A, a CIFD 10*a* is shown attached to a ski 12. The ski 12 has a tip portion 14, shovel 16, tail 18 and running surface 20. The CIFD is principally comprised of a frame 22*a* and a tubular assembly 24. The tubular assembly 24 is cantilevered with respect to frame 22*a* to facilitate oscillation of the tubular assembly 24 relative to the frame 22*a*. The frame includes an integral ski-tip protector 21*a* which is integrated into the ski-tip portion 14.

The tubular assembly 24 is comprised of an elongated flexible or elastic tube 26, the tube having an interior chamber 27 in which a plurality of particles 28 are stuffed, and a mass 30 disposed at a first end 32 of the tube 26 to seal the same. The tube 26 is fabricated from a soft plastic or rubber material. This elasticity enables a sufficient volume of particles 28 to be tightly stuffed into the tube 26. The greater the diameter expansion of the tube, the greater the stiffness of the tubular assembly and resulting inter-particle friction. The particles 28 can be made from metallics, ceramic, glass, sand or the like. The selection of materials for the particles can be tailored to provide a desirable effective density. The mass 30 can be selected from similar materials. For ski applications, a total weight of the tubular assembly in the range of from about 0.5 to 1.5 ounces, with a tube length between two (2) to four (4) inches and an outer diameter between 0.25 to 0.50 inches has demonstrated favorable results in testing. The tubular assembly 24 is attached to the vertical wall 31 of the frame 22*a* in a cantilevered arrangement at the second end 33 of the tube 26. The tubular assembly 24 oscillates relative to the frame 22 when the ski 12 vibrates.

During low amplitude ski vibration, the tubular assembly 24 oscillates a nominal amount and damping is effectuated by transferring vibration kinetic energy to the particles 28 which is dissipated as heat by inter-particle dry friction effects. At higher amplitude vibrations, the tubular assembly 24 will be displaced a greater amount and damping will be realized through momentum transfer caused by the first end 32 (containing the mass 30) impacting a pair of stops 34*a*, 34*b* which are respectively disposed on the top and bottom walls 36*a*, 36*b* of frame 22*a*. The stops 34*a*, 34*b* should have a sufficient elasticity such that the stop/tube-mass pad tip coefficient of restitution falls in the range of from about 0.2 to 0.7. The coefficient of restitution quantifies the damping factor for a vibro-impact damper. Thus, the dissipation of high amplitude vibration is a function of two separate mechanisms, impact and friction. This arrangement has been demonstrated to be effective with respect to a much broader range of frequencies and amplitudes than traditional tuned mass dampers of the type known in the art. The CIFD may be packaged in a variety of frame configurations depending upon the intended application. With regard to ski equipment, the CIFD can be placed proximal to the tip portion 14, on the shovel 16, or near the tail 18, depending upon the ski's flexural properties and the desired characteristics.

Referring now to FIGS. 1B and 2B, a CIFD 10*b* includes an adjustment control 25 coupled to the respective stops 34*a*, 34*b* to select the amount of damping to provide a desired ski "feel" or to facilitate installation on a variety of skis. Control 25 is operably connected to the stops 34*a*, 34*b* by suitable means (not shown) so that the gap between the stops 34*a*, 34*b* and the tubular assembly 24 can be varied. Thus, when the stops 34*a*, 34*b* are moved closer to the tubular assembly 24, lower amplitude vibration will be damped by momentum transfer in addition to heat dissipation through friction resulting in higher overall damping. Conversely, when the stops 34*a*, 34*b* are moved away from the tubular assembly 24, the increased gap width prevents the tubular assembly 24 from impacting the stops 34*a*, 34*b* during low amplitude vibration and thereby provides reduced overall damping. This adjustability allows the skier to select the damping factor best suited to his or her preference in "ski feel" or to account for changes in ski behavior in variable snow conditions. Alternatively, the variable damping characteristic makes a single CIFD 10*b* well-suited for use with a variety of skis, by allowing the damping to be selected to best compliment the ski's vibrational characteristics, i.e., the flex pattern, natural frequency (resonance) and the like.

Referring now to FIGS. 1C and 2C, a third embodiment of a CIFD 10*c* has the tubular assembly 24 extending forwardly from the rear of the frame 22*c* and the adjustment control 25 is disposed near the front of the frame 22*c*. This damper operates on the same principles as described above. Similarly, FIG. 1D depicts a fourth embodiment 10*d* in which the adjustment control 25 is situated on the rear face 23 of the frame 22*d*.

Referring now to FIGS. 3–5, a first embodiment of a ICLD 100 is comprised of a spacer 102, at least one viscoelastic sheet 104 and at least one constraining layer 106. The viscoelastic sheet is selected from a material having a high loss factor of from about 0.3 to greater than 1 in the frequency and temperature range of interest. The spacer 102 separates the viscoelastic sheet from the surface 108 of the vibrating body (e.g., ski 12). The constraining layer is stiff so as not to stretch excessively and is designed to force the viscoelastic layer 104 to deform in shear. Such an arrangement provides an enhanced damping effect. However, to mitigate any additional bending stiffness from being imparted to the ski 12 caused by the increased area moment of inertia of the spacer, it is provided with a plurality of periodically spaced slots or apertures 112. Each slot 112 is typically about 0.008 to 0.1 inches in width, and adjacent slots are spaced about 0.25 to 1.25 inches apart. This reduces the bending stiffness of the assembly, while at the same time providing higher shear strength and to some degree torsional rigidity.

In the first embodiment 100 depicted in FIGS. 3–4, the spacer structure 101 is a hat section comprised of a top panel 114 and a pair of opposed side panels 116, where each side panel terminates in a flange 118 for attachment to surface 108 of the ski 12. The side panels 116 and top panel 114 have slots 112 as described above. If further reduced bending stiffness is required, slots 112 can extend partially into or across the top panel 114 as shown in FIG. 5. A viscoelastic sheet 104 is applied to the exterior surfaces of the top panel 114 and side panels 116, respectively, preferably by bonding. A constraining layer 106 is bonded over the viscoelastic sheet 104 to form a sandwiched assembly. In a modification of the first embodiment 100, a viscoelastic sheet 104 and constraining layer 106 are also disposed on the inner surfaces of the spacer relative to the ski 12, as shown in FIG. 6. In a further modification of the first embodiment, the viscoelastic layers 104 and constraining layers 106 are continuous as shown in FIG. 7.

In a second embodiment 200 shown in FIG. 8, the spacer 201 is tubular, comprised of a top panel 202, side panels 204 and a bottom panel 206. The viscoelastic sheet 104 is bonded to the exterior surfaces of the top panel 114 and side panels 116, and/or the interior surfaces of the same as shown in FIG. 9. The constraining layer 106 is then bonded to the viscoelastic layer to form a sandwiched assembly.

In a third embodiment 300, the spacer structure 302 is arcuate in cross-section as shown in FIG. 10. A viscoelastic sheet 104 and constraining layer 106 are applied to form a sandwiched assembly as discussed above.

In a fourth embodiment 400 shown in FIG. 11, the spacer structure 402 has an I-beam cross-section, comprising an upstanding wall 404, an upper flange 406 and a lower flange 408. A viscoelastic sheet 104 and overlying constraining layer 106 are bonded to both sides of the upstanding wall 404 and the top surface of flange 406.

In a fifth embodiment 500 shown in FIG. 12, the spacer structure 502 is comprised of two C-shaped members 503 having an upstanding wall 504, an upper flange 506 and a lower flange 508. A viscoelastic sheet 104 and constraining layer 106 are bonded to the respective outer and inner faces of the upstanding walls 504 and the upper flanges 506 of members 503.

In a sixth embodiment 600 shown in FIG. 13, the spacer structure 602 is comprised of two members 604 having an L-shaped cross-section, each member having an upstanding wall 606 and a lower flange 608. A viscoelastic sheet 104 and constraining layer 106 are bonded to the respective outer and inner faces of the upstanding walls 606 of members 604.

In a seventh embodiment 700 shown in FIG. 14, the spacer structure 702 is comprised of two (2) nested U-shaped channel members 704*a*, 704*b* having a viscoelastic sheet 104 and constraining layer 106 laminated on the exterior of member 704*a*, and between members 704*a* and 704*b*.

In all of the above-described embodiments, damping is effectuated by the dissipation of vibrational bending strain energy into heat resulting from the interlaminar shear generated between the support structure, viscoelastic sheet(s) and constraining layer(s). With respect to ski applications, it is advantageous and most effective to attach the ICLD to the upper surface of the ski at regions which experience high modal strain energy. The low order vibrational modes, which are predominantly responsible for high amplitude vibrations are more effectively attenuated by locating the ICLD near the middle two thirds of the ski.

Although the present invention has been shown and described with specific preference to ski equipment, it is anticipated that the CIFD and ICLD embodiments in accordance with the present invention are amenable to any application where vibration damping may be necessary. As discussed above, the CIFD and ICLD may be utilized separately or in combination depending upon the amount of damping necessary for the particular application. Although the implementations shown are considered to be the most practical and preferred embodiments, it is anticipated that departures may be made therefrom and that obvious modifications will occur to persons skilled in the art.

We claim:

1. A combination vibrating body and damper for damping vibration in the vibrating body, comprising:

a frame affixed to the vibrating body;

a flexible, elongated tubular member having an interior chamber and a mass disposed proximal to a first end of said tubular member, said tubular member being cantilevered with respect to said frame at a second end of said tubular member to enable said tubular member and said mass to oscillate relative to said frame, said frame having a first stop and a second stop disposed in confronting relation about said tubular member to damp high amplitude vibration through alternating impact between said first end of said tubular member and said mass, and said first stop and said second stop; and a plurality of particles disposed in said interior chamber of said tubular member to damp low amplitude vibration by dissipating vibration kinetic energy thorough inter-particle friction as said tubular member oscillates relative to said frame.

2. The combination vibrating body and damper recited in claim 1, wherein said tubular member is sealed at said first end of said tubular member with said mass.

3. The combination vibrating body and damper recited in claim 1, wherein said tubular member contains a density of said plurality of particles sufficient to diametrically expand said tubular member to exert a preloaded force on said particles when at rest and increase the longitudinal transverse stiffness of said cantilevered tubular member.

4. The combination vibration body and damper recited in claim 1, wherein said first stop and said second stop are movable to vary a gap between each of said stops and said tubular member to vary the damping of said damper.

5. A combination ski and damper for damping vibration in the ski, the ski having a tip portion, shovel and tail, comprising:

a frame affixed proximal to the tip portion of the ski;

a flexible elongated tubular member having an interior chamber and a mass disposed proximal to a first end of said tubular member, said tubular member being cantilevered with respect to said frame at a second end of said tubular member to enable said tubular member and said mass to oscillate relative to said frame, said frame having a first stop and a second stop disposed in confronting relation about said tubular member to damp high amplitude ski vibration through alternating impact between said first end of said tubular member and said mass, and said first stop and said second stop; and a plurality of particles disposed in said interior chamber of said tubular member to damp low amplitude ski vibration by dissipating vibration kinetic energy through inter-particle friction as said tubular member oscillates relative to said frame, said tubular member containing a density of said particles sufficient to diametrically expand said tubular member to exert a preloaded force on said particles when at rest and increase the transverse stiffness of said tubular member.

6. A combination ski and damping system for damping vibration in the ski, the ski having an elongated longitudinal extent including a tip portion, shovel and tail, comprising:

a frame affixed proximal to the tip portion of the ski;

a flexible elongated tubular member having an interior chamber and a mass disposed proximal to the first end of said tubular member, said tubular member being cantilevered with respect to said frame at a second end of said tubular member to enable said tubular member and said mass to oscillate relative to said frame, said frame having at least one of a first stop and a second stop disposed in confronting relation about said tubular member to damp high amplitude ski vibration through alternating impact between said first end of said tubular member and said mass, and at least one of said first stop and said second stop;

a plurality of particles disposed in said interior chamber of said tubular member to damp low amplitude vibration by dissipating vibration kinetic energy through inter-particle friction as said tubular member oscillates relative to said frame;

a spacer having an elongated longitudinal extent, said spacer defining a plurality of slots spaced along said longitudinal extent of said spacer to reduce the bending stiffness of said spacer, said spacer being secured to said ski proximal to at least one of said tip portion, said shovel and said tail;

at least one viscoelastic sheet attached to said spacer, said at least one viscoelastic sheet having an elongated longitudinal extent of substantially the same length as said spacer; and at least one constraining layer attached to said at least one viscoelastic sheet to sandwich said viscoelastic sheet between said constraining layer and said spacer.

* * * * *